US010137048B2

(12) United States Patent
Haene

(10) Patent No.: US 10,137,048 B2
(45) Date of Patent: Nov. 27, 2018

(54) STRETCHING APPARATUS FOR STRETCHING THE BACK

(71) Applicant: Marcel Haene, Seengen (CH)

(72) Inventor: Marcel Haene, Seengen (CH)

( * ) Notice: Subject to any disclaimer, the term of this patent is extended or adjusted under 35 U.S.C. 154(b) by 207 days.

(21) Appl. No.: 15/110,741

(22) PCT Filed: Jan. 13, 2015

(86) PCT No.: PCT/IB2015/050253
§ 371 (c)(1),
(2) Date: Jul. 10, 2016

(87) PCT Pub. No.: WO2015/107458
PCT Pub. Date: Jul. 23, 2015

(65) Prior Publication Data

US 2016/0331622 A1 Nov. 17, 2016

(30) Foreign Application Priority Data

Jan. 15, 2014 (CH) ..... 0043/14

(51) Int. Cl.
*A61H 1/02* (2006.01)
*A63B 23/00* (2006.01)

(52) U.S. Cl.
CPC ..... *A61H 1/0222* (2013.01); *A61H 1/0229* (2013.01); *A61H 2203/0493* (2013.01); *A63B 2023/006* (2013.01)

(58) Field of Classification Search
CPC ..... A61F 5/00
See application file for complete search history.

(56) References Cited

U.S. PATENT DOCUMENTS 1,079,795 A * 11/1913 Naysmith ..... A61H 1/0218 606/244
1,529,872 A * 3/1925 Craig ..... 601/49
2,630,800 A * 3/1953 Voss ..... A61H 1/0222 5/610
2,915,057 A * 12/1959 Ammon ..... A61H 23/0254 601/58

(Continued)

OTHER PUBLICATIONS

International Preliminary Report on Patentability (IPRP).

*Primary Examiner* — Loan H Thanh
*Assistant Examiner* — Rae Fischer
(74) *Attorney, Agent, or Firm* — PatShegen IP; Eva Taksel

(57) ABSTRACT

Stretching apparatus consisting of a base plate having a vertically adjustable mast and an upper end of which a lying element is mounted. The lying element is pivotable about a horizontal shaft. Adjustable restraining elements with pads for the arms and the feet are attached to movable slides. A standing surface extending perpendicularly to the lying element is formed thereon. Handle bars for controlling pivoting of the lying element are articulated at the upper mast part. The movable slides are connected with the restraining means on the lying element via cable pulls having a steel cable about a plurality of deflecting rollers. By pivoting the lying element about the horizontal position, the slides with the pads can be moved apart and back toward each other again. By rocking about the horizontal position of the lying element, the back can be alternately stretched and relaxed.

15 Claims, 7 Drawing Sheets

(56) References Cited

U.S. PATENT DOCUMENTS

Figure 1:
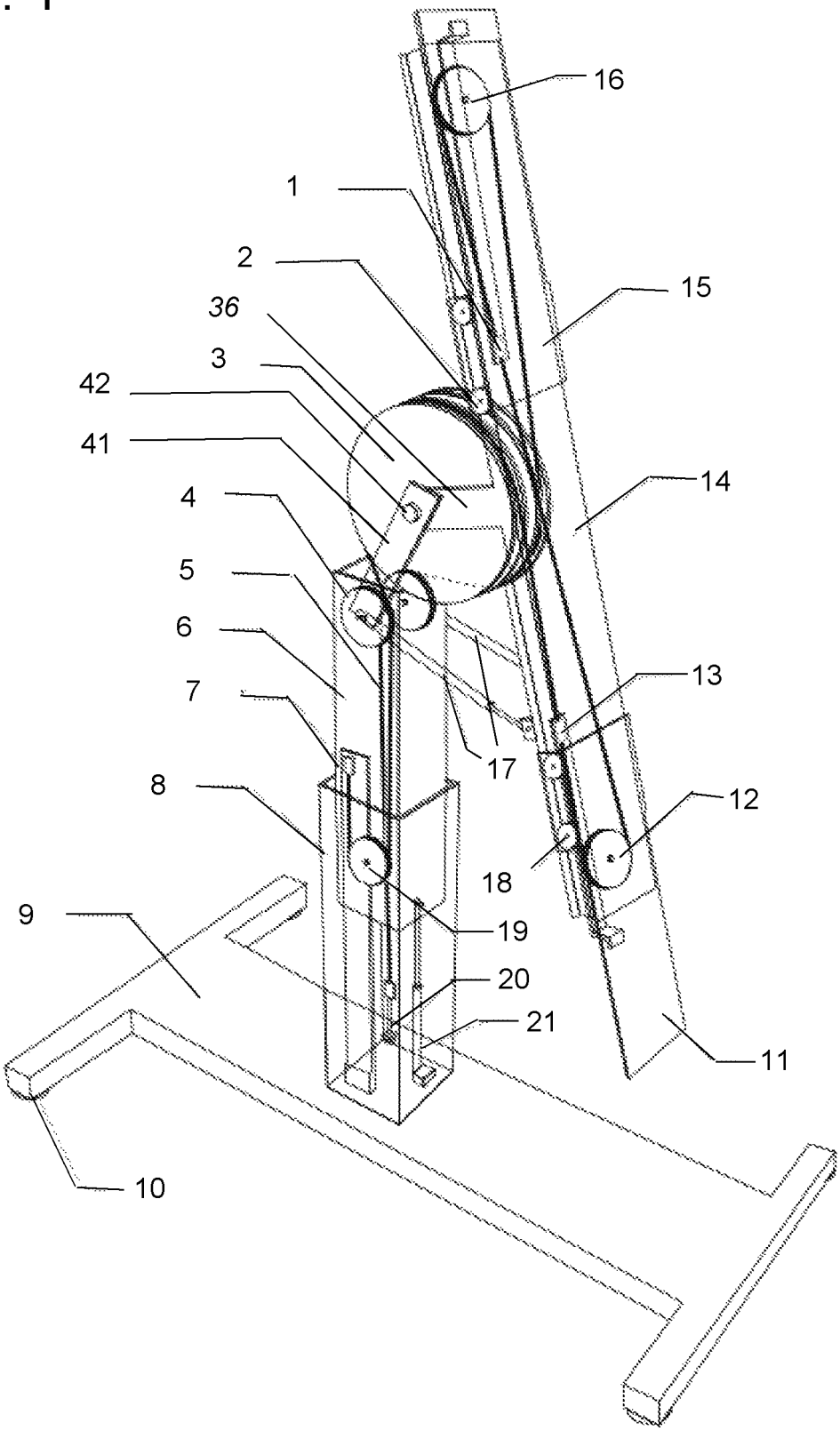

| | | | | | |
|---|---|---|---|---|---|
| 3,060,925 | A | * | 10/1962 | Honsaker | A61H 1/003 601/24 |
| 3,238,936 | A | * | 3/1966 | Siedentop | A61F 7/007 5/284 |
| 4,360,009 | A | | 11/1982 | Weisman | |
| 4,890,604 | A | * | 1/1990 | Nelson | A61H 1/0229 602/32 |
| 4,915,101 | A | | 4/1990 | Cuccia | |

* cited by examiner

STRETCHING APPARATUS FOR STRETCHING THE BACK

The invention relates to a stretching appliance for the automatic stretching of one's own back. Many people suffer from back pain, and a stretching of their back on a stretching bed brings relief. However, conventional stretching beds are not so user-friendly and often cannot be operated alone, so that a person to be treated cannot therefore effectively use the stretching bed alone, but a therapist or an auxiliary person is required.

It is therefore the object of this invention, to specify a stretching appliance for stretching the back, which is extremely simple and pleasant to use, can be variably set for different body sizes and by way of which the stretching of the back can be very finely metered by the user himself during the application.

The object is achieved by a stretching appliance, consisting of a floor plate with mast which is adjustable in height thereon, at the upper end of said mast a rest is assembled, characterised in that the rest is pivotably mounted about a horizontal axis, that adjustable restraining means for the shoulders and feet are present on the rest and are connected to one another such that they can be moved apart and conversely can be moved again towards one another, in a coupled manner, by way of pivoting the rest about the horizontal position.

This stretching appliance and its individual parts are represented in the drawings and are described hereinafter, wherein the function of the stretching appliance is also explained and discussed.

Figure 2:
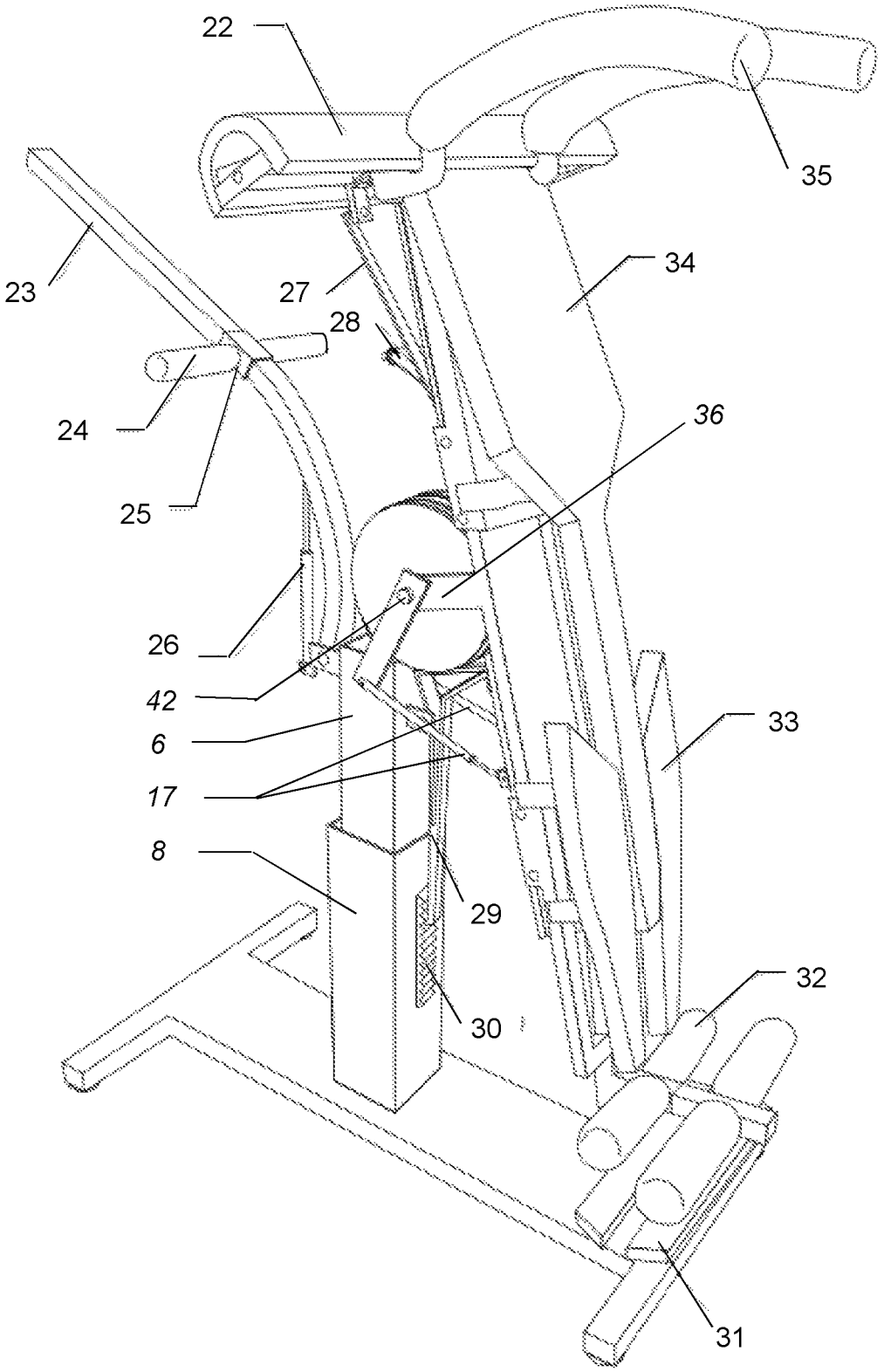
Figure 3:
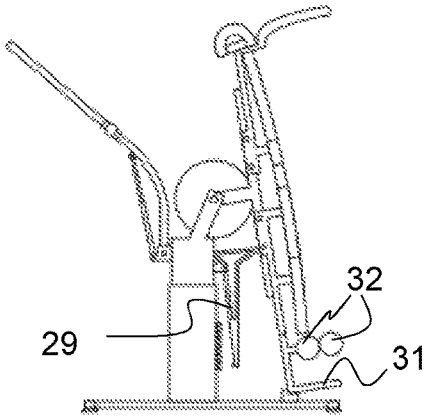
Figure 4:
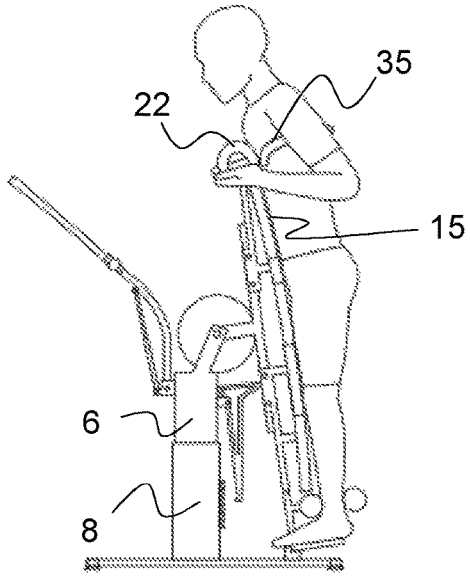
Figure 5:
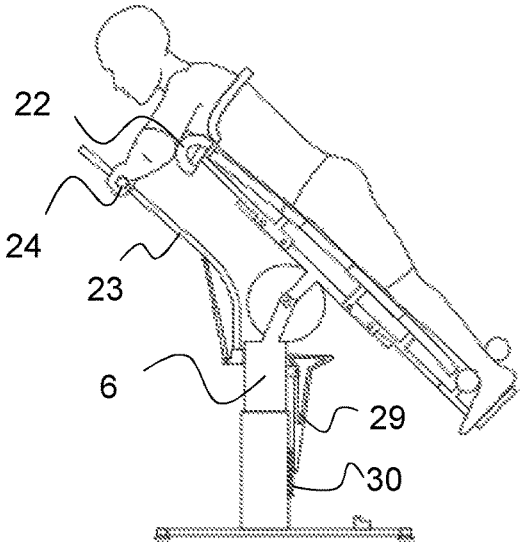
Figure 6:
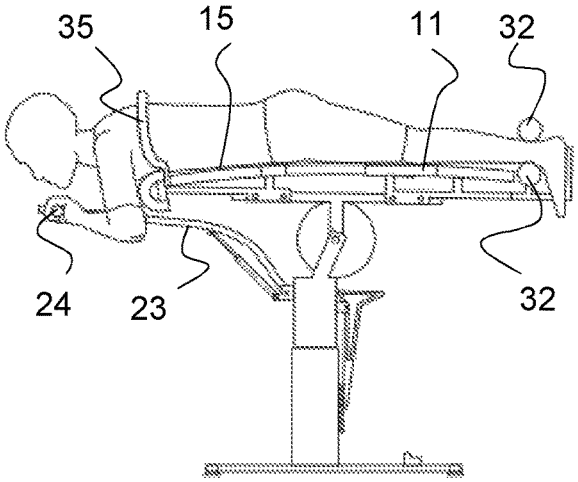
Figure 7:
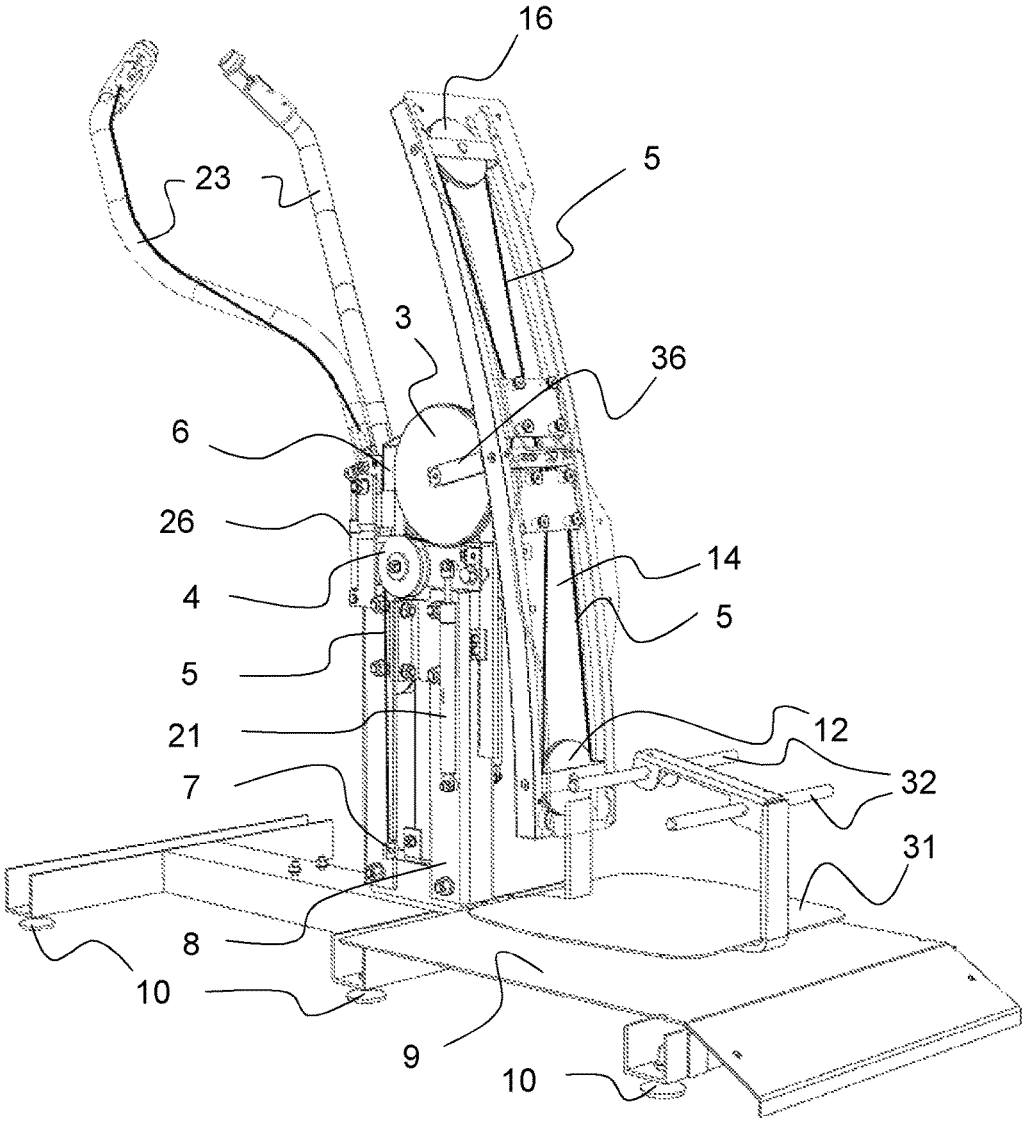
Figure 8:
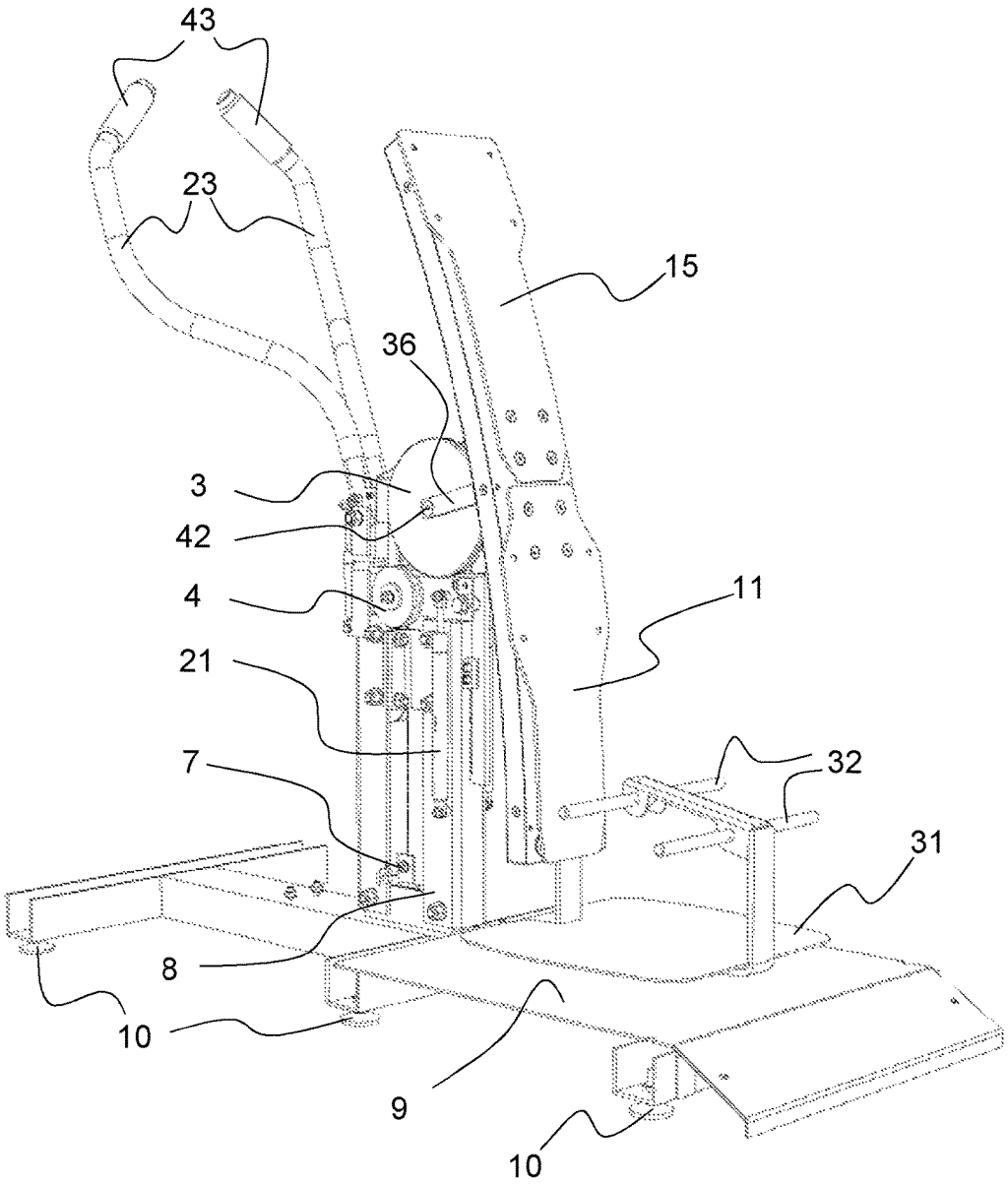
Figure 9:
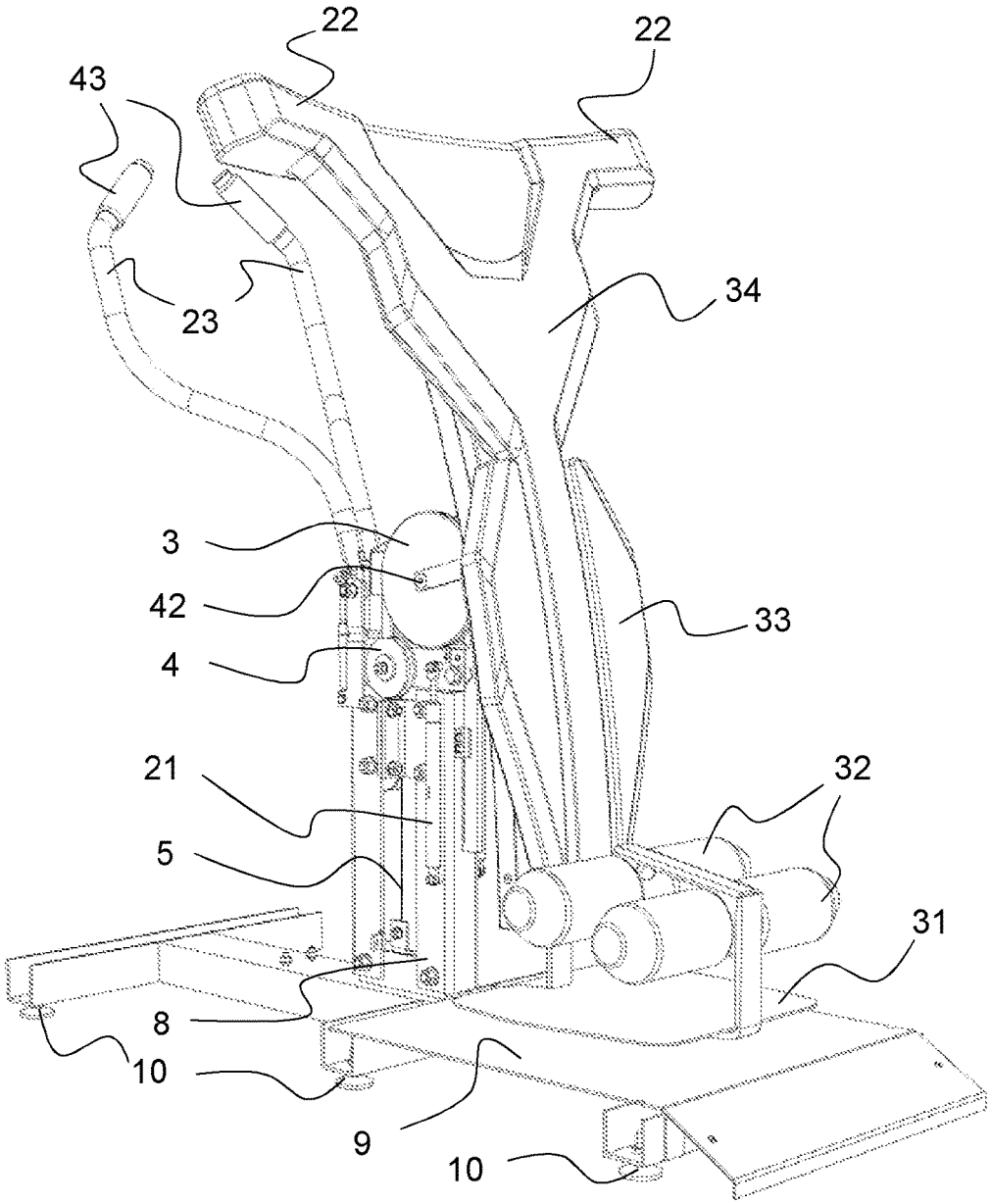
Figure 10:
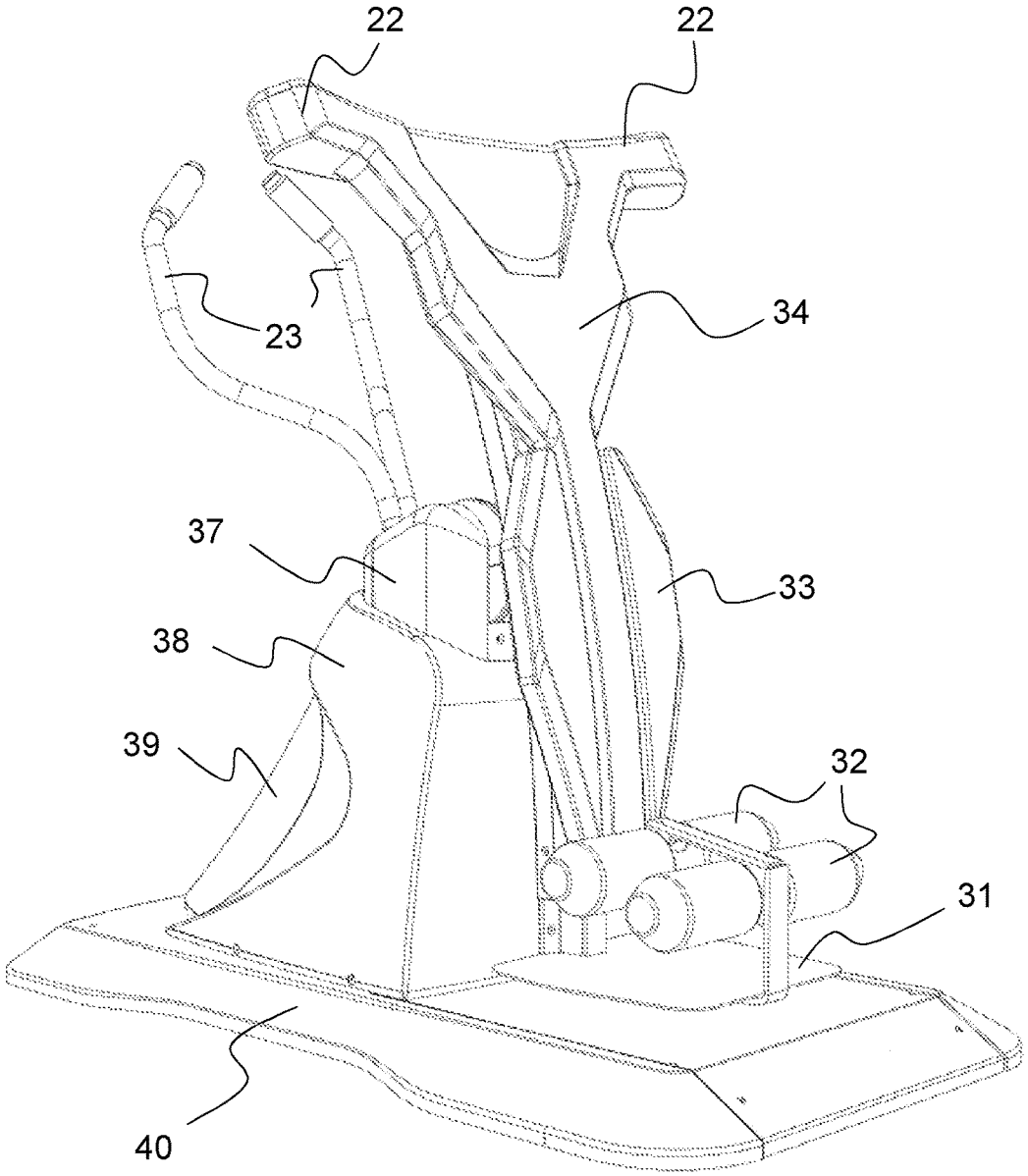

There are shown in:

FIG. 1 the stretching appliance in a perspective view, with its functional construction for the pivoting of the rest, for the mutual displacement of the carriages which are displaceably arranged thereon, as well as for changing the length of the rest for differently tall persons;

FIG. 2 the compete stretching appliance in a perspective view, with the pads on the rest, said pads being attached on the two longitudinally displaceable carriages;

FIG. 3 the stretching appliance seen from the side, ready for use;

FIG. 4 the stretching appliance seen from the side, after having been mounted by a person for its use;

FIG. 5 the stretching appliance seen from the side, on pivoting the rest into the horizontal position, at half the pivot path;

FIG. 6 the stretching appliance seen from the side, on seesawing the rest about the horizontal position, and by way of this, the well-metered stretching and relaxation of the back;

FIG. 7 a refined design of the stretching appliance with a view into the inside, i.e. without cover plates or carriages;

FIG. 8 the refined design of the stretching appliance according to FIG. 7, with the two carriages 11, 15;

FIG. 9 the refined design of the stretching appliance according to FIGS. 7 and 8, with a breast pad, and pads on the carriages, as well as with foot pads;

FIG. 10 the refined design of the stretching appliance according to FIG. 9 with the casing of the mechanics, of the floor plate and of the height-adjustable feet.

FIG. 2 shows the basic construction of this stretching appliance. It comprises a floor plate 9 with height-adjustable feet 10, so that these can be adjusted for a level resting in the case that the floor is not quite even, so that the stretching appliance stands on the floor without wobbling at all. A mast which here consists of two square profiles stands on the base plate 9. The square profile which is larger with regard to its inner dimensions forms a lower mast part 6, and the square profile which is smaller with regard to its inner dimensions forms the upper mast part 6 which is inserted in the lower mast part 8 and is guided therein and can be telescopically extended upwards out of this. A large deflection pulley 3 with two cable grooves is assembled at the upper end of the upper mast part 6. Its pivot 42 is carried by two limbs 41 which here are fastened on the upper mast part 6 obliquely to this. The rest consists of a base plate 14 as well as two carriages 11, 15 which are mounted on this base plate 14 in a displaceable manner in the longitudinal direction of the rest. The carriage 11 which is here at the bottom runs on the rollers 18 and is envisaged for the legs, and the upper carriage 15 rolls on the carriage rollers 2 and is envisaged for the upper body. The base plate 14 is articulated on the pivot 42 of the large deflection pulley 3 via two rigid limbs 36 which project downward perpendicularly from it. With this, the rest with its base plate 14 and its two carriages 11, 15 as a whole is pivotable about the axis of the deflection pulley 3 and can thus be pivoted out of the approximately vertical position which is shown here, into a horizontal position and somewhat beyond this. A series of further components are present on the described elements of the stretching appliance, and these serve for the height adjustment of the rest, the pivoting of the rest as well as the synchronous displacement of the carriages 11, 15 to one another or away from one another, to be able to be effected smoothly and with little force effort. A cable pull with a steel cable 5 serves for this, and this steel cable 5 from a cable clamp 7 on the upper mast part 6 firstly leads downwards and then around a deflection roller 19 which is likewise assembled on the upper mast part 6. The steel cable 5 then leads upwards from this deflection roller 19, around a deflection roller 4 assembled at the upper end of the upper mast part 6, and from there, in the represented view, in the clockwise direction around the large deflection pulley 3 and from this onto the lower carriage 11, at the lower end of which a deflection roller 12 is assembled. The steel cable 5 is led around this deflection roller 12, and afterwards to a cable clamp 13 and then to the cable clamp 1 on the upper carriage 15. The steel cable 5 at the other side of this cable clamp 1 leads further around a deflection roller 16 on the upper carriage 15, and then back via the large deflection pulley 3 with its two cable grooves. The steel cable 5 is led around this deflection pulley 3 in the clockwise direction in the represented angle of view, and then led onto a small deflection roller 4 on the side of the upper mast part 6 which is at the rear in the picture, and around this in the anti-clockwise direction in the shown view, and from this finally down into the lower mast part 8, on which the cable end of the steel cable 5 is fastened via a cable tensioner 20.

The setting of the lying height of the rest is effected by way of telescopic extension of the mast with its two mast parts 8, 6, which is assisted by a gas compression spring 21 of the type which are installed for boot lids of automobiles. The weight of the rest is thus practically neutralised and the mast can be extended and retracted with only little force effort. The rest is secured at a set height, as is represented by way of FIG. 2. The picture in FIG. 1 thus only shows the basic framework for the height adjustment and the pivoting of the rest into the horizontal position, as well as the rollers 2, 18 for the mounting of the displaceable carriages 11, 15, at the lower end and upper end of the rest. The cable pull with its steel cable 5 and its two fixedly clamped ends is designed and led in a manner such that the carriages 11, 15 always move synchronously to one another, thus are commonly or mutually displaced towards one another or however are mutually moved apart. As is explained later, in this context they are also displaced such that the rest can be adapted to the height of a certain person in an extremely simple manner. These positions of the carriages 11, 15 which are set once for a person, are retained thereafter, even if the complete rest is pivoted about the axis pivot of the deflection pulley 3, and they are also retained irrespective of the height of the rest which was previously set by way of adjustment of the mast.

FIG. 2 goes into more detail and shows that special pads 33, 34 are assembled on the carriages. A two-part pad 33 for both legs is assembled on the lower carriage, and a pad 34 for the upper body and which in the middle continues downwards between the leg pads 33 is assembled on the upper slide. The edges of the pads 33, 34 which lie opposite one another are bevelled with respect to the longitudinal direction of the rest. The pads 33, 34 are pushed together in an exactly fitting manner when the carriages are displaced to one another, and they get into the position as is shown in FIG. 2, when displaced apart. The rest at the end which is at the bottom here is shaped out into a standing surface 31 or a footboard, upon which one can step in the shown position of the rest. The restraining elements in the form of foot pads 32 for the ankles are to be seen above this standing surface 31. Hereby, it is the case of padded rollers for each foot. The user for example firstly with his one foot, from the outside, steps between the two rollers or foot pads 32 and places the foot upon the standing surface 31. The same is done with the other foot afterwards. Both feet are then on the standing surface 31 and the two padded rollers enclose the lower leg just above the ankles. An upper arm pad 22 in the form of a cross member to the rest is arranged at the upper end and of the rest and is connected to the upper carriage and therefore as a whole is displaceable on the rest in the longitudinal direction of the rest. Two tube arcs below this cross member project upwards on the rest, similarly to fork prongs, wherein these are also padded. These fork prongs form the armpit support pads 35, as will become apparent further below when explaining the usage of the stretching appliance. The two armpit support pads 35, on the cross member of the upper arm pad 22, can be displaced outwards in each case in opposite directions to one another thanks to a synchronisation mechanism 27 with restoring springs 28, in order to be able to set different thorax widths.

The upper arm pad 22 as well as the armpit support pads 35 therefore together with the upper carriage 15 are displaceable on the rest in the longitudinal direction of this rest, wherein their displacement effects or forces the exact complementary, oppositely directed displacement of the lower carriage 11 with the restraining elements or foot pads 32 for the ankles, thanks to the clever cable connection. FIG. 2 moreover shows two gas compression springs 17 between the upper region of the upper mast part 6 and the rest. These gas compression springs 17 assist the pivoting of the rest about the rotation pivot or axis 42 of the deflection pulley 3, so that to all intents and purposes a torque compensation is ensured, and the pivoting and return pivoting of the rest is effected with little force effort, which is to say only a low torque needs to be mustered.

A grip bar 23 is articulated on the upper mast part 6 at the side of this upper mast part 6 which is at the left in the picture, which is to say at the front. A slide 25 is displaceably mounted on this arcuate grip bar 23 and carries the hand grips 24 projecting at both sides, and the grip bar 23 is supported by a gas compression spring, so that its weight is neutralised. A toothed rail 30, on which a locking lever 29 with its front detent or locking tooth locks in, is assembled on the opposite rear side of the lower mast part 8. This locking lever 29 is pivoted away from the toothed rail 30, in the idle position, when no user stands on the standing surface 31. It is only locked in via a mechanism at that moment when pivoting or tilting procedure of the rest is initiated, as is described hereinafter.

FIG. 3 shows the stretching appliance seen from the side, in the starting or initial position. One recognises that the locking lever 29 is released, and the stretching appliance is mounted by the user in this position. For this, he approaches from the right in the picture and steps with his first foot upon the standing surface 31, wherein for this he pushes his ankles from the outer side between the foot pads 32. This are pushed apart by way of this. The user thereafter places his other foot upon the standing surface 31 in the same manner. Next one can better consider FIG. 4. The user opens the armpit support pads 35 by way of him pushing the two prongs formed by these pads, apart in the horizontal direction, which is effected by a mechanism which ensures the synchronous movement of the twp prongs, until the user with his upper body just fits between these and can lean with this breast on the upper carriage 15. He then lifts the cross member with the upper arm pad 22 by hand, until the armpit support pad 35 can come to lie directly below his armpits, as is shown in FIG. 4. On lifting the cross member with the upper arm pad 22, the upper mast part 6 by way of this is also simultaneously pulled out of the lower mast part 8 by a certain relation which is given by the cable pull, so that the complete stretching appliance is automatically adapted to the body height of the user. A taller user requires a pivot axis which lies higher than in the case of a short user.

In the next step, as is shown in FIG. 5, the user grips the grips 24 on the grip bar 23 and pulls himself together with the rest, on which he now leans, towards the grip bar 23. The upper arm pads 22 thereby come to lie below the upper arms, directly subsequent to the shoulder, and by way of this the locking lever 29 with its tooth is engaged on the toothed rail 30 on account of a mechanical connection. On pulling on the grip bar 23, as a result the rest is tilted and pivots in a controlled manner towards its horizontal position, as is shown in FIG. 5, where half the pivot movement has already been covered. The complete pivot movement however is damped by way of the two gas compression springs 17 (FIG. 1, 2) which are not drawn here and which are between the rest and the upper mast part 6, and this movement can therefore be effected in a completely gentle manner, under 100% control of the user. He controls the pivoting with the grips 24 on the grip bar 23. The more he pushes these grips 24 on the grip bar 23 to the front, the more rapidly is the pivoting into the horizontal position effected, and the two carriages 15, 11 are moved apart in accordance with the extent of this pivoting into the horizontal position.

The user finally reaches the horizontal position on the rest, as is represented in FIG. 6. The grips 24 which on a slide are displaceable on the grip bar 23 are pushed towards the end of the grip bar 23. The actual stretching of the back is now effected in this position, specifically by way of the user, by way of him holding on the grips 24, rocking which is to say seesawing somewhat forwards and backwards with the rest. When he seesaws forwards, the two carriages 11, 15 are pushed apart by the pull cable as a result of the pivoting of the rest about the mast, in accordance with the extent of the seesaw movement in the forwards direction. The foot pads 32 on the one hand, and the armpit support pads 32 as well as the upper arm pads 22 on the other hand, increase their distance to one another—and the back of the user is stretched. The upper arm pads 22 thereby form a counterbearing for the armpits, which is necessary so that the back can be stretched between the armpits and the foot pads 32 by way of the two carriages 15, 11 moving apart. Conversely, when the user pushes away from the grips 24, then a pivoting of the rest in the opposite direction, thus in the clockwise direction in the picture, is activated. This pivoting of the rest about the mast, as a result of the cable pull connections, has the effect that the two carriages 11, 15 with the armpit support pads 35 and the foot cushion 32 are pushed towards one another which leads to a relaxation of the back. The user therefore can stretch his back intermittently to the exact extent as he feels is good for him, by way of very simple and very well controllable seesaw movements. He has complete control over the stretching at all times and can immediately relax at any time, in the case that the stretching becomes too much for him. In many cases, a few seesawing movements are sufficient, in order to cause a very sufficient relief and to ease tension in the back region, in a beneficial manner.

FIG. 7 shows a refined design of the stretching appliance without carriage, padding and casings. One can recognise the important design features, specifically the base plate 14 of the rest, on which the two carriages which are not yet placed are then mounted in a rolling manner. Deflection rollers 12, 16 for cable leading of the steel cable 5 are arranged in a manner lying on the base plate. The complete base plate 14 is connected to the pivot 42 of the large deflection pulley 3 via the two limbs 36 and is pivotable about this pivot or axis 42. The standing surface 31 with the two holders for the feet or the lower leg just above the ankles is further visible. The gas compression spring 21 for assisting the extension of the mast is visible on the mast. One can moreover see the cable clamp 7 for fastening the one end of the cable 5 to the upper mast part 6, as well as the deflection roller 4 and the large deflection pulley 3 to the upper mast part 6. It is merely two arcuate grip bars 23 whose ends directly form grips 43, which serve here instead of an individual grip bar 23 (FIG. 2) with hand grips 24 which are displaceable therein. These grip bars 23 are aligned at an angle of 80-100° to one another, so that they are aligned in an ergonomically favourable manner for gripping. The grip bars 23 are moreover connected to the upper mast part 6 by way of a gas compression spring 26. The stretching appliance stands on a floor plate 9 with height-adjustable feet 10.

The stretching appliance with the two carriages 15, 11 which are now placed on is shown in FIG. 8. These two carriages 15, 11 can be rolled away from one another in a synchronous which is to say equal and opposite manner, and can be rolled towards one another, again in a synchronous manner, which is ensured by the leading of the installed cable pull about the deflection rollers which are arranged below the two carriages 11, 15. With the stretching appliance as represented in FIG. 9, the padding and the casing have been built on. Firstly, the upper carriage is provided with a padding 34 which here at its upper end also comprises a construction lying at the inside which is formed into an upper arm pad 22. The upper end of this upper arm pad 22 therefore comes to lie on the upper arms of the user, directly below his armpits, when he grips the two arcuate grip bars 23 at their front ends or grips 43, over these two upper arm pads 22. The lower carriage is likewise provided with a padding 33, wherein the padding 34 of the upper carriage can be pushed into a central recess in the padding 33 of the lower carriage, when the two carriages are pushed together. The holders for the feet are provided with cylindrical foot pads 32. The lower leg can clamped in between these two foot pad pairs, in a manner close to the ankles, after the user has stepped on the standing surface 31 and has placed his legs between foot pad pairs. The steel cable 5 and the gas compression spring 21 for assisting the upwards extension of the mast and thus for assisting the lifting of the base plate which is to say the rest together with the deflection roller 4 and the large deflection pulley 3 for leading the steel cable 5 of the pull cable, can be recognised on the mast parts. The stretching appliance is represented in the coupled condition in FIG. 10. The complete mechanical construction in the inside of its mast as well as the mast itself, are covered by casing parts 37, 38, 39. The floor plate is also enclosed all around by a casing 40.

LIST OF REFERENCE NUMERALS

1 cable clamp, top
2 carriage roller, top
3 large deflection pulley
4 deflection roller
5 steel cable
6 mast part top
7 cable clamp on mast
8 mast part, bottom
9 floor plate
10 height-adjustable feet
11 carriage bottom, at the foot side of the rest
12 deflection roller on the carriage, bottom
13 cable clamp, bottom
14 base plate of the rest
15 carriage, top, at the head side of the rest
16 deflection roller carriage, top
17 damper, base plate
18 carriage roller, bottom
19 deflection roller
20 cable tensioner
21 gas compression spring for extending the mast
22 upper arm pad
23 grip bar
24 hand grip
25 slide
26 gas compression spring for grip bar
27 mechanism, width setting
28 restoring spring for mechanism 27
29 locking lever
30 toothed rail
31 standing surface
32 foot pad
33 pad on foot-side carriage
34 pad on head-side carriage
35 armpit support pad
36 limbs projecting perpendicularly from the base plate 14
37 casing of the upper mast part
38 casing mast
39 casing front on the mast
40 all-round casing of the floor plate 9
41 limbs on the upper mast part
42 pivot of the large deflection pulley 3
43 grips on the grip bars 23

The invention claimed is:

1. A stretching appliance, comprising:

a floor plate (9) having a mast (6, 8) upwardly disposed on said floor plate (9) and having an adjustable height;

a rest mounted on said mast and being configured for supporting a human body, said rest is pivotably mounted to said mast (6, 8) and is being configured to pivot about a horizontal axis (42);

shoulders restraining means adjustably mounted on a first end of said rest and being configured to hold shoulders of a human body laying on said rest;

feet restraining means adjustably mounted on a second end of said rest and being configured to hold feet of the human body laying on said rest; and an adjusting mechanism configured for adjusting distance between said shoulder restraining means and feet restraining means by way of pivoting the rest about the horizontal axis.

2. A stretching appliance according to claim 1, wherein the adjusting mechanism includes a first carriage (15) which is displaceable in the longitudinal direction of the rest and which is connected to the shoulders restraining means; and a second carriage (11) which is displaceable in the longitudinal direction of the rest, and which is connected to the feet restraining means wherein the first and second carriages are connected to one another by cables such that they can be rolled or displaced apart and conversely can be moved again towards one another, in a coupled manner, by way of pivoting the rest about the horizontal axis.

3. A stretching appliance according to claim 2, wherein the first and second carriages (15, 11) are provided with pads (34, 33) which can be displaced or pushed into one another.

4. A stretching appliance according to claim 1, wherein the rest is pivotably mounted on a upper end of the mast, and wherein the shoulders restraining means include arm pads (22) disposed transversely to the rest and are configured for supporting regions of the upper arms of the user, adjacent the shoulder, and said shoulder restraining means are built on a first displaceable carriage (15) at a head side of the rest, and the feet restraining means are built on a second displaceable carriage (11) at a foot side of the rest and wherein the foot end includes a standing surface (31) which runs perpendicularly to the rest and wherein said adjusting mechanism includes at least one grip bar (23) for manually controlling pivoting of the rest, said grip bar is articulated on the front side of an upper part of the mast, wherein the first and second displaceable carriages (15, 11) bearing the shoulder and feet restraining means, can be moved apart and conversely can be moved again towards one another in a coupled manner by way of-cable pulls acting on the carriages (15, 11) and on the mast (6, 8) over deflection rollers, activated by way of the pivoting of the rest about the horizontal axis.

5. A stretching appliance according to claim 4, wherein the mast includes a lower mast part (8) and of an upper mast part (6), the latter being telescopically guided in the lower mast part (8), and the rest is pivoted about a horizontal pivot axis (42) on the upper mast part (6), and wherein said must includes a deflection pulley (3) with two cable grooves, and a steel cable (5) attached in a cable clamp (7) on the upper mast part (6), said steel cable extends from said cable clamp (7) downwards, around a first deflection roller (19) mounted on a lower end of the upper mast part (6), and around a second deflection roller (4) mounted on an upper end of the upper mast part (6), and from said second deflection roller on the upper mast part (6) and further extends around a first side of the deflection pulley (3) and a third deflection roller (12) mounted on said second displaceable carriage (11), and around a cable clamp (1) mounted on the first displaceable carriage (15), and further extends around a forth deflection roller (16) mounted on the first displaceable carriage (15) and around a second side of the deflection pulley (3), and extends back around said second deflection roller (4) on the upper mast part (6) towards a cable tensioner (20) mounted on the lower mast part (8).

6. A stretching appliance according to claim 4, wherein the grip bar (23) is curved forwards and is provided with a slide (25), on which two grips (24) are projecting to the left and right, and wherein the grip bar (23) is connected to the upper end of the mast by way of a gas compression spring (26), configured for force neutralisation and for force damping.

7. A stretching appliance according to claim 4, wherein two arcuate grip bars (23) are articulated on the upper mast part (6) and their ends are designed as grips (43) for ergonomic gripping and end at an angle of 80-100° to one another, wherein the grip bars (23) are connected to the upper mast part (6) by way of a gas compression spring (26), for force neutralisation and for force damping.

8. A stretching appliance according to claim 4, wherein the shoulders adjustable restraining means further include armpit support pads (35) for supporting the armpits and having arched and padded tubes which extend substantially perpendicularly from the plane of the first displaceable carriage (15).

9. A stretching appliance according to claim 8, wherein the armpit support pads (35) include synchronisation mechanism for adjusting the distance between the armpit support pads synchronously to the middle line of the rest.

10. A stretching appliance according to claim 1, wherein said adjusting mechanism includes a cable pull with a cable (5) of a fixed length and a set of deflection rollers (19, 4, 3, 12, 16), such that said shoulders and feet restraining means can be moved apart and conversely can be moved again towards one another, in a coupled manner, by way of the pivoting of the rest about the horizontal axis.

11. A stretching appliance according to claim 1, wherein the first and second carriages (11, 15) are mounted on the rest by rollers configured to allow displacement thereof in the longitudinal direction with respect to the rest.

12. A stretching appliance according to claim 1, wherein the rest includes gas compression springs (17) configured to allow pivot movement of the rest with respect to the mast.

13. A stretching appliance according to claim 1, further comprising a locking lever (29) having locking tooth configured to engage a toothed rail (30) on the mast wherein the locking can be activated by way of a mechanism, by way of pivoting the rest.

14. A stretching appliance according to claim 1, further comprising at least one gas compression spring (21), for receiving the weight of the mast and of the rest, said at least one gas compression spring is installed between an upper part of the mast and a lower part of the mast, so that height adjustment of the rest can be carried out in a largely weight-neutralised manner.

15. A stretching appliance according to claim 1, further comprising casing parts for housing the the adjusting mechanism and the mast.

* * * * *